US012371846B2

(12) United States Patent
Lee et al.

(10) Patent No.: US 12,371,846 B2
(45) Date of Patent: Jul. 29, 2025

(54) WASHING MACHINE WITH DRYING FUNCTION

(71) Applicant: SAMSUNG ELECTRONICS CO., LTD., Suwon-si (KR)

(72) Inventors: Hyounyoung Lee, Suwon-si (KR); Heejin Kang, Suwon-si (KR); Bongjin Ko, Suwon-si (KR); Younghyun Kim, Suwon-si (KR); Seulgi Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 345 days.

(21) Appl. No.: 18/117,571

(22) Filed: Mar. 6, 2023

(65) Prior Publication Data

US 2023/0265597 A1 Aug. 24, 2023

Related U.S. Application Data

(63) Continuation of application No. PCT/KR2022/021490, filed on Dec. 28, 2022.

(30) Foreign Application Priority Data

Feb. 23, 2022 (KR) ..... 10-2022-0023934

(51) Int. Cl.
*D06F 58/20* (2006.01)
*D06F 25/00* (2006.01)
(Continued)

(52) U.S. Cl.
CPC ..... *D06F 58/206* (2013.01); *D06F 25/00* (2013.01); *D06F 37/42* (2013.01); *D06F 39/12* (2013.01); *D06F 58/04* (2013.01)

(58) Field of Classification Search
CPC ..... D06F 58/206
See application file for complete search history.

(56) References Cited

U.S. PATENT DOCUMENTS 7,805,965 B2 10/2010 Kim et al.
9,683,325 B2 6/2017 Kim et al.
(Continued)

FOREIGN PATENT DOCUMENTS

EP 2 339 063 A2 6/2011
EP 2 351 883 A2 8/2011
(Continued)

OTHER PUBLICATIONS

International Search Report, PCT/ISA/210, dated Apr. 5, 2023, in International Application No. PCT/2022/021490.
(Continued)

*Primary Examiner* — Jason Y Ko
(74) *Attorney, Agent, or Firm* — STAAS & HALSEY LLP

(57) ABSTRACT

A washing machine including a main body; a tub disposed inside the main body; a drum rotatably disposed inside the tub; a drying device including a compressor so that the drying device is configured to remove moisture from air discharged from the tub, heat the air from which the moisture was removed, and supply the heated air to the tub; and a support device disposed between the tub and the drying device. The support device may include a first support member longitudinally extending along a front and back direction of the main body, and a second support member longitudinally extending along a left and right direction of the main body, wherein at least one of the first support member and the second support member passes below the
(Continued)

compressor, so that the first support member and the second support member are thereby configured to support the drying device above the tub.

11 Claims, 7 Drawing Sheets

(51) Int. Cl.

| | |
|---|---|
| ***D06F 37/42*** | (2006.01) |
| ***D06F 39/12*** | (2006.01) |
| ***D06F 58/04*** | (2006.01) |

(56) References Cited

U.S. PATENT DOCUMENTS

| | | | |
|---|---|---|---|
| 10,273,627 | B2 | 4/2019 | Yoon et al. |
| 10,344,424 | B2 | 7/2019 | Kim et al. |
| 10,697,110 | B2 | 6/2020 | Shin et al. |
| 10,988,894 | B2 | 4/2021 | Kim et al. |
| 2016/0115641 | A1 | 4/2016 | Kim et al. |
| 2017/0191212 | A1 | 7/2017 | Yoon et al. |
| 2017/0191213 | A1 | 7/2017 | Kim et al. |
| 2019/0264379 | A1 | 8/2019 | Kim et al. |

FOREIGN PATENT DOCUMENTS

| | | | |
|---|---|---|---|
| EP | 2 468 172 | A1 | 6/2012 |
| EP | 2 660 381 | B1 | 5/2016 |
| EP | 3 252 213 | B1 | 9/2019 |
| JP | 2010-107 | | 1/2010 |
| JP | 4396483 | B2 | 1/2010 |
| JP | 5232134 | | 7/2013 |
| JP | 5649039 | B2 | 1/2015 |
| KR | 10-2009-0109182 | A | 10/2009 |
| KR | 10-1013375 | B1 | 2/2011 |
| KR | 10-2017-0082045 | A | 7/2017 |
| KR | 10-2017-0082046 | A | 7/2017 |
| KR | 10-2018-0079801 | A | 7/2018 |
| KR | 10-2129793 | | 7/2020 |
| KR | 10-2302326 | | 9/2021 |
| WO | WO 2017/119586 | A1 | 7/2017 |
| WO | WO 2017/119587 | A1 | 7/2017 |

OTHER PUBLICATIONS

Written Opinion, PCT/ISA/237, dated Apr. 5, 2023, in International Application No. PCT/KR2022/021490.

Extended European Search Report dated Jan. 7, 2025 for European Patent Application No. 22929105.9.

WASHING MACHINE WITH DRYING FUNCTION

CROSS-REFERENCE TO RELATED APPLICATIONS

This application a continuation application of PCT International Patent Application No. PCT/KR2022/021490, filed Dec. 28, 2022 which is based on and claims priority under 35 U.S.C. § 119 to Korean Patent Application No. 10-2022-0023934, filed on Feb. 23, 2022 in the Korean Intellectual Property Office, the disclosures of which are incorporated by reference herein in their entireties.

BACKGROUND

1. Field

The disclosure relates to a washing machine, and more particularly, to a washing machine which can perform a drying function using a drying device installed at an upper part of the washing machine.

2. Description of the Related Art

Until recently, a washing machine which washes laundry and a dryer which dries laundry have been formed as separate devices. However, in cases where the washing machine and the dryer are formed as separate devices as described above, there has been an inconvenience for the user having to wait for the laundry to be completed and moving the washing completed laundry to the dryer.

To solve the inconvenience described above, a washing machine with drying function is being developed.

However, in cases where the drying device for performing the drying function is disposed at an upper part of a drum, sagging may occur due to a weight of the drying device resulting in a distance between the drying device and the drum becoming closer, and there is a problem of damage and noise generating due to an impact between the drying device and the drum.

SUMMARY

Aspects of embodiments of the disclosure will be set forth in part in the description which follows and, in part, will be apparent from the description, or may be learned by practice of the presented embodiments.

According to an embodiment of the disclosure, a washing machine may include a main body; a tub disposed inside the main body; a drum rotatably disposed inside the tub; a drying device including a compressor so that the drying device is configured to remove moisture from air discharged from the tub, heat the air from which the moisture was removed, and supply the heated air to the tub; and a support device disposed between the tub and the drying device. The support device may include a first support member longitudinally extending along a front and back direction of the main body, and a second support member longitudinally extending along a left and right direction of the main body, wherein at least one of the first support member and the second support member passes below the compressor, so that the first support member and the second support member are thereby configured to support the drying device above the tub.

According to an embodiment of the disclosure, the main body includes a front surface, a back surface, a first side surface, and a second side surface, and the compressor is disposed closer to the back surface of the main body than to the front surface of the main body, and disposed closer to the first side surface than to the second side surface.

According to an embodiment of the disclosure, the second support member is disposed closer to the back surface of the main body than to the front surface of the main body, and an area of the second support member is disposed under the compressor.

According to an embodiment of the disclosure, the drying device further includes a housing which contains the compressor, and the support device is configured to support an area of the housing of the drying device disposed under the compressor.

According to an embodiment of the disclosure, the housing includes a convex area under the compressor, and a portion of the support device which is disposed under the compressor includes a concave area engaged with the convex area of the housing.

According to an embodiment of the disclosure, the washing machine further includes a cushioning member disposed between the concave area of the portion of the support device and the convex area of the housing, and configured to cushion impact between the support device and the housing.

According to an embodiment of the disclosure, the cushioning member is formed of a material including at least one of a sponge and a rubber.

According to an embodiment of the disclosure, the first support member includes a convex area extending in an upward direction and configured to support a center part of the drying device.

According to an embodiment of the disclosure, the washing machine further includes a cushioning member disposed between the convex area of the first support member and the center part of the drying device and configured to cushion impact between the first support member and the drying device.

According to an embodiment of the disclosure, the support device is configured to support the drying device so that the drying device is spaced apart from the tub.

According to an embodiment of the disclosure, the washing machine further includes a cushioning member disposed between the support device and the drying device, and configured to cushion impact between the support device and the drying device Additional embodiments of the disclosure will be set forth in part in the description which follows and, in part, will be obvious from the description, or will be apparent from the disclosure.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
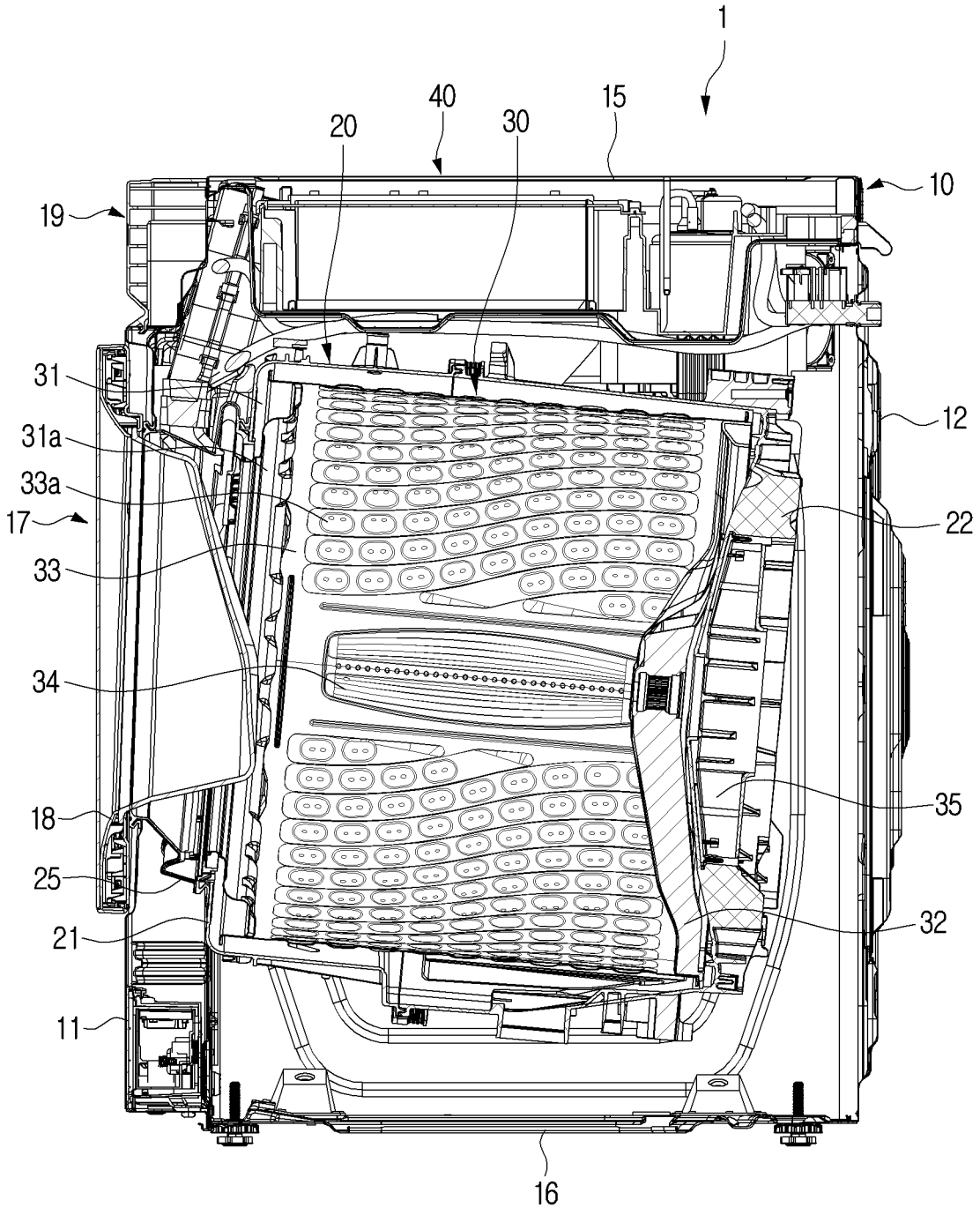
FIG. 1 is a cross-sectional view illustrating a washing machine according to an embodiment of the disclosure.

Embodiments described herein are provided as examples to assist in the understanding of the disclosure, and it is to be understood that the disclosure may be variously modified and realized, differently from the embodiments described herein. However, in describing the disclosure below, in case it is determined that the detailed description of related known technologies may unnecessarily confuse the gist of the disclosure, the detailed description and detailed illustration will be omitted. In addition, accompanied drawings are not shown in its actual scale but shown with scales of some elements exaggerated to assist in the understanding of the disclosure.

Terms used in the disclosure and in the claims are general terms selected considering their function herein. However, the terms may change depending on intention, legal or technical interpretation, emergence of new technologies, and the like of those skilled in the related art. Further, in certain cases, there may be terms arbitrarily selected. With respect to these terms, the meaning of the term may be interpreted as defined in the description, and if there is no specific definition of the term, the term may be interpreted based on the overall context of the disclosure and the technical common sense of the related art.

In describing the disclosure, the order of each step is to be understood as non-limiting unless the order of each step needs to be performed such that a preceding step must be performed logically and temporally prior to a following step. That is, except for exceptional cases as described above, even if a process described as the following step is performed preceding a process described as the preceding step, it does not influence the nature of the disclosure and the scope of protection should also be defined regardless of the order of the step.

In the disclosure, expressions such as "have," "may have," "include," "may include," or the like are used to designate a presence of a corresponding characteristic (e.g., elements such as numerical value, function, operation, or component), and not to preclude a presence or a possibility of additional characteristics.

Terms such as first and second may be used in describing various elements, but the elements are not limited by the above-described terms. The above-described terms may be used only for the purpose of distinguishing one element from another element. For example, a first element may be designated as a second element, and likewise, a second element may be designated as a first element without exceeding the scope of protection.

In addition, terms such as 'front surface,' 'back surface,' 'upper surface,' 'lower surface,' 'side surface,' 'left side,' 'right side,' 'upper part,' 'lower part,' and the like used in the disclosure may be defined based on the drawings, and forms and positions of each element are not limited by these terms.

Further, elements necessary in describing each embodiment of the disclosure are described herein, but the disclosure is not necessarily limited thereto. Accordingly, some elements may be modified or omitted, and other elements may be added. In addition, the elements may be distributed and disposed in separate devices different from one another.

Furthermore, embodiments of the disclosure have been described in detail with reference to the accompanied drawings and descriptions described in the accompanied drawings below, it is to be understood that the disclosure is not limited by or limited to the embodiments.

The disclosure will be described in greater detail below with reference to the accompanied drawings.

FIG. 1 is a cross-sectional view illustrating a washing machine according to an embodiment of the disclosure.

Referring to FIG. 1, a washing machine 1 according to an embodiment of the disclosure may include a main body 10, a tub 20, a drum 30, a drying device 40, and a support device 100.

The main body 10 may form an exterior of the washing machine 1, and may be formed in a roughly in a rectangular parallelepiped shape. The main body 10 may include a front surface cover 11, a back surface cover 12, a left side cover 13 (referring to FIG. 2), a right side cover 14 (referring to FIG. 2), an upper part cover 15, and a lower part cover 16.

At a front surface (or front side) of the main body 10, a laundry insertion hole 18 may be provided to load and unload laundry inside of the main body 10. That is, the laundry insertion hole 18 may be provided at the front surface cover 11 of the main body. At the laundry insertion hole 18, a door 17 may be installed so as to be openable and closeable.

At an upper part of the front surface cover 11 of the main body 10, a control panel 19 which may control the washing machine 1 may be provided. The control panel 19 may include a plurality of buttons for controlling the washing machine 1, a display to show information associated with the washing machine 1 and a washing process, and a processor configured to control the washing machine 1.

The tub 20 may be installed at an inside of the main body 10 of the washing machine 1, and may be formed in a hollow cylindrical shape on which a front opening is provided toward the laundry insertion hole 18 of the front surface cover 11. The front opening of the tub 20 may be connected with the laundry insertion hole 18. The tub 20 may include a back opening provided at a back surface 22.

The tub 20 may receive washing water of a predetermined amount necessary in washing. The tub 20 may be supported by and fixed to an inner surface of the main body 10 by a tension spring, an oil damper, and the like.

In between the tub 20 and the front surface cover 11 of the main body 10, a diaphragm 25 may be installed. The diaphragm 25 may be formed roughly in an annular shape. One end of the diaphragm 25 may be fixed to a front surface 21 of the tub 20 at which the front opening is provided, and other end of the diaphragm 25 may be fixed to an inner circumference of the laundry insertion hole 18 of the front surface cover 11 of the main body 10. That is, the diaphragm 25 may connect the laundry insertion hole 18 of the main body 10 with the front opening of the tub 20.

The diaphragm 25 may be configured such that the washing water contained in the tub 20 is not leaked to an outside of the tub 20, and may form a pathway through which the laundry passes. In addition, the diaphragm 25 may block vibration which is generated when the drum 30 is rotated from being transferred to the front surface cover 11 of the main body 10 through the tub 20.

The drum 30 may be installed at an inside of the tub 20 to be rotatable, and may be formed roughly in a hollow cylindrical shape. At a front surface 31 of the drum 30, a drum opening 31*a* corresponding with the laundry insertion hole 18 of the washing machine main body 10 may be provided, and at a back end of the drum 30, a back surface plate 32 may be provided.

At a side surface 33 of the drum 30, a plurality of through-holes 33*a* through which the washing water may pass may be provided. The back surface plate 32 of the drum 30 may also be provided with a plurality of through-holes 32*a*. Accordingly, air inside the drum may be discharged to a space between the drum 30 and the tub 20 through the plurality of through-holes 33*a* formed at the side surface 33 of the drum 30 and through the plurality of through-holes 32*a* formed at the back surface plate 32.

In addition, at an inner circumferential surface of the drum 30, a plurality of lifts 34 which may raise the laundry may be provided. The drum 30 may rotate about a central axis by a driving device which includes a driving motor 35 installed at the back surface plate 32.

At the upper part of the tub 20, a water supply device for supplying water to the tub 20 may be provided, and at the lower part of the tub 20, a water draining device for draining water from the tub 20 to the outside may be disposed.

The water supplying device may include a water supply pipe connected with an external water supply source and a water supply valve which opens and closes the water supply pipe. One end of the water supply pipe may be connected to the diaphragm 25. The water supply pipe may be provided with a detergent intake part.

The water draining device may be formed to discharge the washing water contained in the tub 20 to the outside of the washing machine 1. The water draining device may be installed at the lower part of the tub 20, and may include a pump and a water drain pipe. When the pump is operated, the washing water contained in the tub 20 may be discharged to the outside of the washing machine 1 through the water drain pipe.

At the upper side of the tub 20, the drying device 40 for drying the laundry which was washed by a rotation of the drum 30 may be installed. The drying device 40 may be formed to generate heated air with moisture removed by heating and drying air which is discharged from the tub 20, and to dry the laundry located inside of the drum 30 by circulating the heated air to the inside of the tub 20.

In between the tub 20 and the drying device 40, the support device 100 which supports the drying device 40 may be disposed. The support device 100 may be connected to the main body 10 and may support the drying device 40 such that the drying device 40 is spaced apart from the tub 20 by a certain distance.

Accordingly, the support device 100 may solve the problem of damage or noise occurring due to the drying device 40 contacting the tub 20 by reinforcing stiffness of the main body 10 which supports the drying device 40.

A structure of the support device 100 according to an embodiment will be described in detail below with reference to the drawings.

Figure 2:
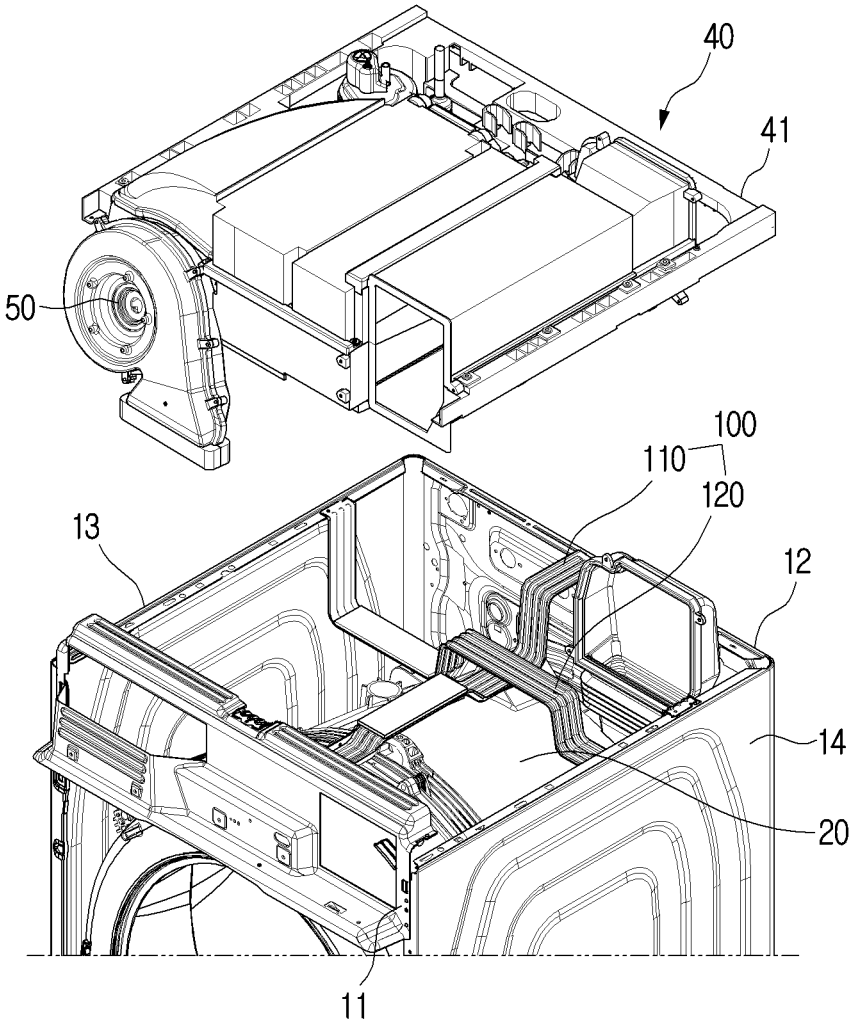
FIG. 2 is an exploded perspective view illustrating a drying device separated from a washing machine according to an embodiment of the disclosure.
Figure 3:
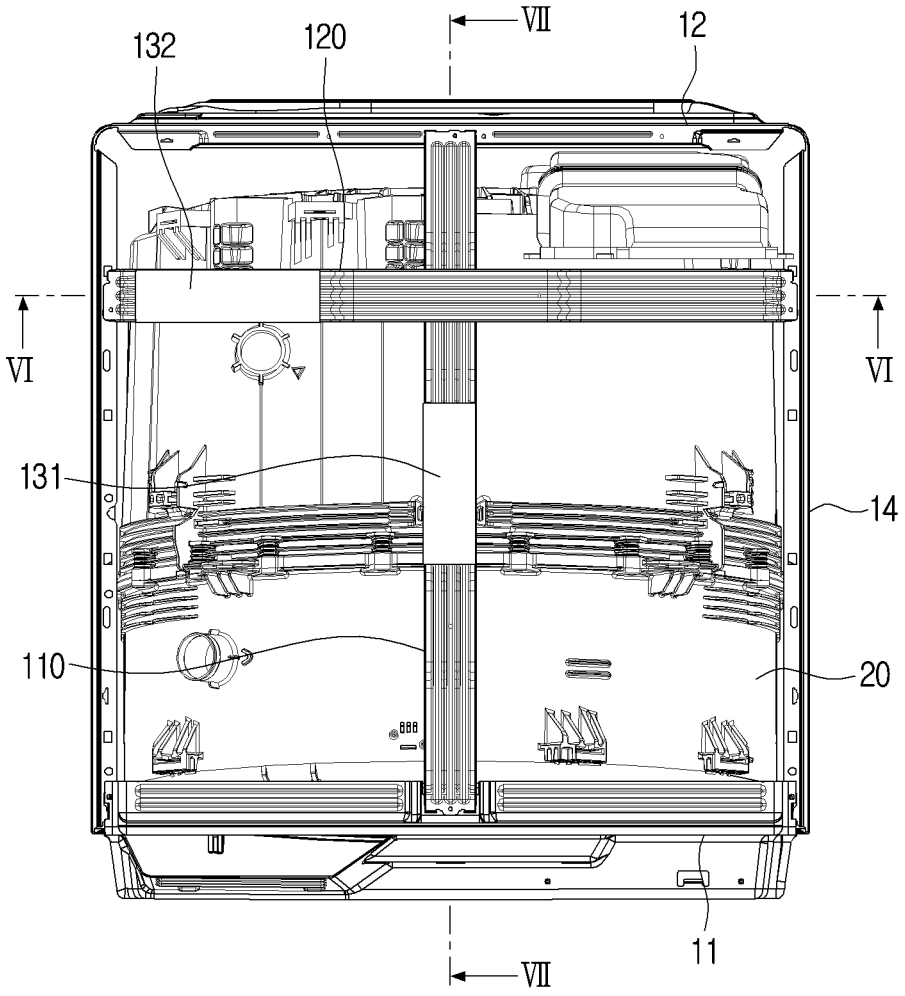
FIG. 3 is a top plan view illustrating a support device being disposed in a washing machine according to an embodiment of the disclosure.

FIG. 2 is an exploded perspective view illustrating the drying device separated from the washing machine according to an embodiment, and FIG. 3 is view seen from a top of a support device being disposed in the washing machine according to an embodiment.

Referring to FIG. 2 and FIG. 3, the support device 100 may be connected to the main body 10 and may support the drying device 40 by being disposed between the tub 20 and the drying device 40.

The support device 100 may include a first support member 110 which includes one end that is connected to the first or front surface of the main body 10 and the other end that is connected to the back surface of the main body 10, and a second support member 120 which includes one end that is connected to the first side surface of the main body 10 and the other end that is connected to a second side surface which faces the first side surface.

The first support member 110 may be extended along a front and back direction of the main body 10, and may be supported with one end coupled to the front surface cover 11 of the main body 10 and the other end coupled to the back surface cover 12 of the main body 10. The second support member 120 may be extended along a left and right direction of the main body 10, and may be supported with one end coupled to the left side cover 13 and the other end coupled to the right side cover 14 of the main body 10. Accordingly, the first support member 110 and the second support member 120 may stably support the drying device 40 disposed at the upper part to be spaced apart from the tub 20.

In between the support device 100 and the drying device 40, cushioning members 131 and 132 for cushioning impact may be disposed. The cushioning members 131 and 132 may have a material including at least one from among a sponge and a rubber. The cushioning members 131 and 132 may be disposed between a bottom surface of a housing 41 of the drying device 40 and the support device 100.

The cushioning members 131 and 132 may be disposed at an area at which a load of the drying device 40 is relatively largely carried at the support device 100. In an example, the cushioning members 131 and 132 may be disposed at a center part of the drying device 40, and disposed at the lower part of a compressor 61. Detailed descriptions associated therewith will be described below with reference to FIG. 6 and FIG. 7.

Figure 4:
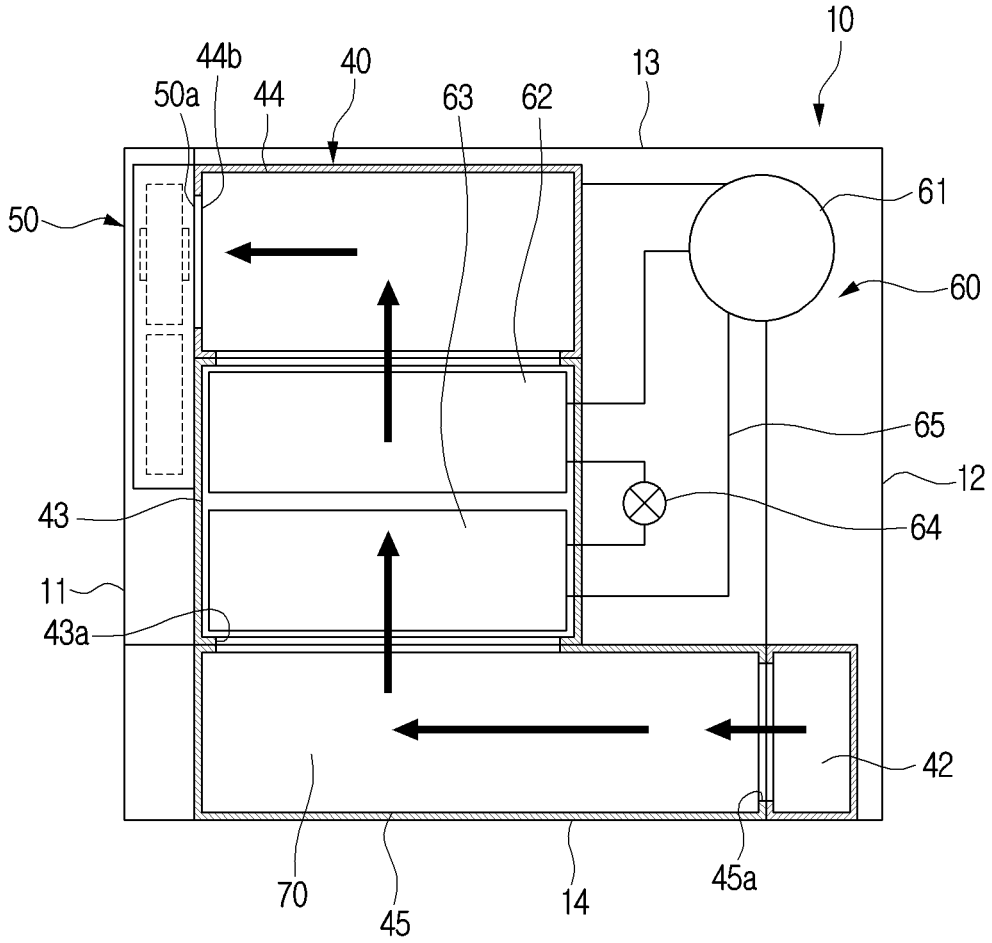
FIG. 4 is a conceptual view of a drying device of a washing machine according to an embodiment of the disclosure.

FIG. 4 is a conceptual view of the drying device of the washing machine according to an embodiment.

Referring to FIG. 4, the drying device 40 may include the housing 41, an inlet duct 42 which forms a flow path connecting the front direction and the back direction of the tub 20, a filter containing part 45, a heat exchange duct 43, and a discharge duct 44, and include a blower fan 50 which generates an airflow that circulates the flow path, and a heat pump 60 for creating high-temperature dried air by removing moisture included in the air which passed the drum and heating the moisture removed air. The filter containing part 45 may introduce air supplied from the intake duct 42 into the filter containing part 45 through the inlet 45*a*. The heat exchange duct 43 may introduce air supplied from the filter containing part 45 into the heat exchange duct 43 through the inlet 43*a*. a outlet 44*b* of the discharge duct 44 is formed on the front surface of the discharge duct 44 and may be connected to the suction port 50*a* of the blowing fan 50.

The heat pump 60 may be formed to create the high-temperature dried air by removing the moisture in air flowing along the flow path which is formed inside of the drying device 40 and heating the moisture removed air. The heat pump 60 may include a compressor 61, a condenser 62, an evaporator 63, and an expansion valve 64. In addition, the heat pump 60 may include a refrigerant pipe 65 which connects the compressor 61, the condenser 62, the evaporator 63, and the expansion valve 64 for a refrigerant to circulate.

The heat pump 60 may be formed for the refrigerant to remove moisture included in the air through a heat-exchange with the air and heat the air while circulating the condenser 62, the expansion valve 64, and the evaporator 63 due to the compressor 61.

The evaporator 63 and the condenser 62 may be installed at the heat exchange duct 43. The evaporator 63 and the condenser 62 may be installed to be spaced apart by a certain distance, and the condenser 62 may be installed at a downstream of the evaporator 63 along a circulation direction of the airflow.

The evaporator 63 may be connected with the inlet duct 42 through a filter assembly 70 which is disposed inside of the filter containing part 45, and may remove moisture by cooling the highly humid air which is discharged from the tub 20.

The condenser 62 may be connected with the blower fan 50, and air is heated by emitting heat with the air discharged to the tub 20. Accordingly, the blower fan 50 may discharge the high-temperature dried air to the tub 20.

The compressor 61 may be installed at a space provided between the discharge duct 44 and the back surface cover 12 of the main body 10. According to an embodiment, the compressor 61 may be disposed more closely to the back surface of the main body 10 than to the front surface of the main body 10, and disposed more closely to the left side surface than to the right side surface of the main body 10. Referring to FIG. 4, the compressor 61 may be disposed more closely to the back surface cover 12 than to the front surface cover 11 of the main body 10, and disposed at a position closer to the left side cover 13 than to the right side cover 14. Accordingly, the compressor 61 may cross and connect the left side cover 13 and the right side cover 14 of the main body 10, and may be disposed at the upper part of the second support member 120 which is disposed closer to the back surface cover 12 than to the front surface cover 11. Accordingly, the stiffness supporting the weight of the compressor 61 may be reinforced through the second support member 120. The detailed structure associated therewith will be described below with reference to FIG. 6.

The washing machine 1 with drying function according to an embodiment of the disclosure that has the above-described structure may be configured such that air inside of the drum forms an airflow when the flower fan 50 is operated, and after passing the inlet duct 42, the filter assembly 70, the heat exchange duct 43, and the discharge duct 44, the air is introduced back to the inside of the drum 30.

At this time, the heat pump is operated removing the moisture in air that is discharged from the drum 30, and may raise the temperature of air. That is, the moisture in air may be removed by the evaporator 63 of the heat pump 60, and the temperature of air may be raised by the condenser 62. The high-temperature dried air may be supplied to the drum 30 by the blower fan 50 and dry the laundry placed in the drum 30.

A structure of the support device 100 according to an embodiment will be described in detail with reference to FIG. 5 to FIG. 7.

Figure 5:
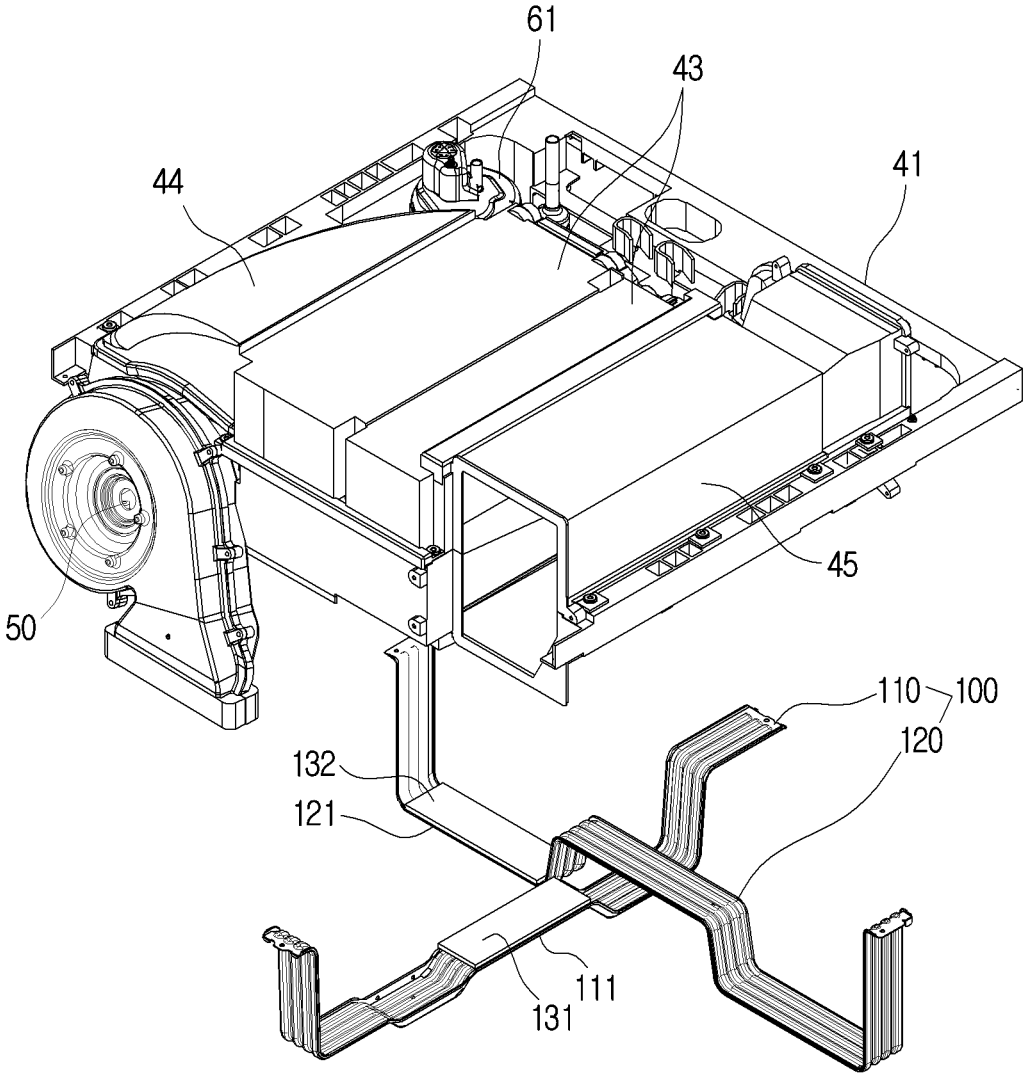
FIG. 5 is a view illustrating a drying device and a support device according to an embodiment of the disclosure.
Figure 6:
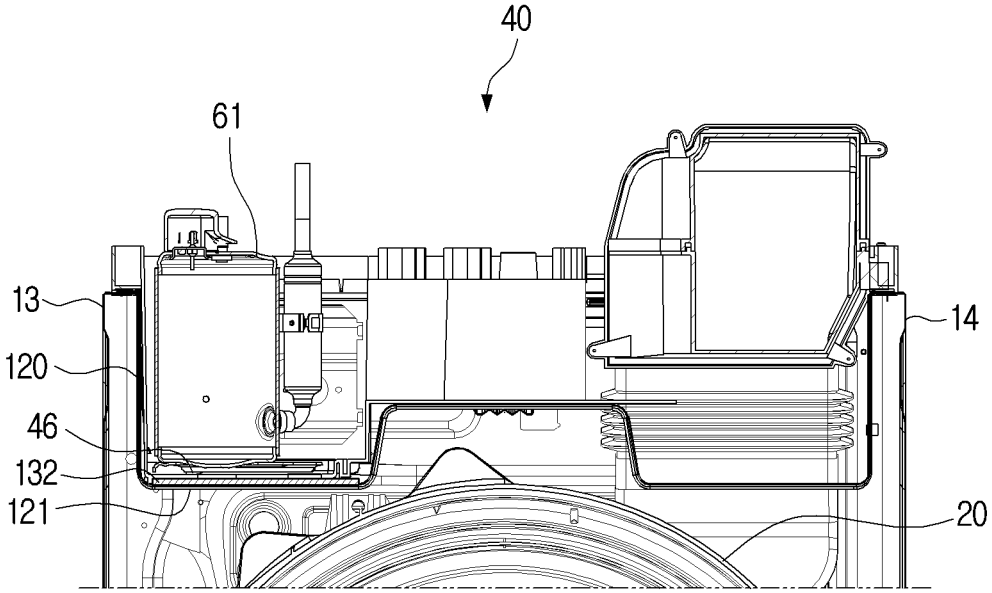
FIG. 6 is a cross-sectional view taken along VI-VI of FIG. 3.
Figure 7:
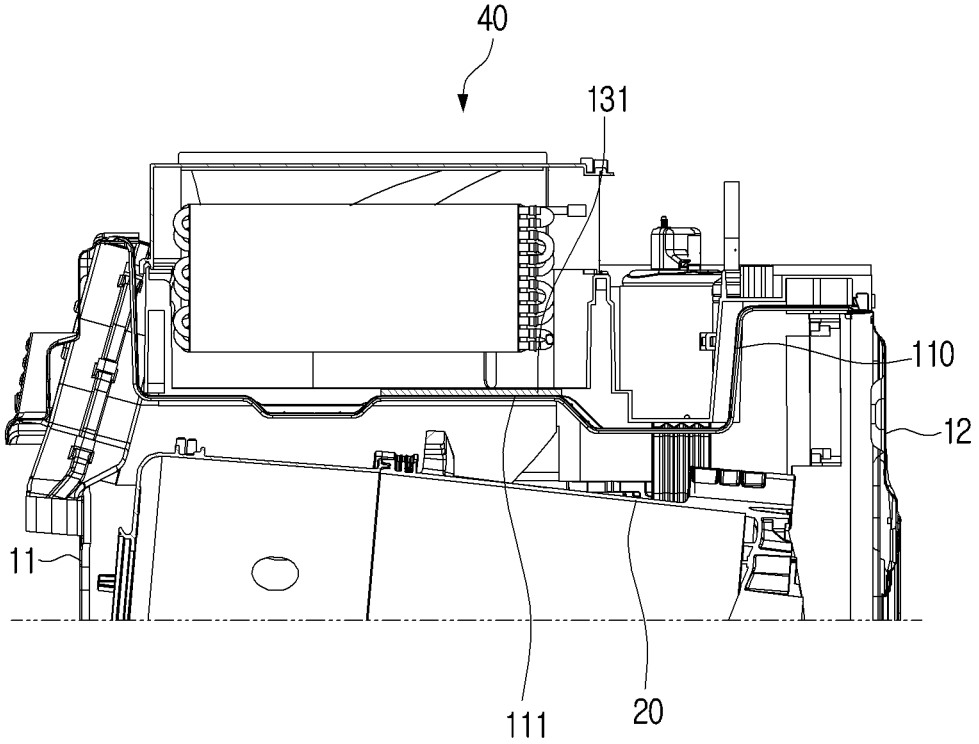
FIG. 7 is a cross-sectional view taken along VII-VII of FIG. 3.

FIG. 5 is a view illustrating the drying device and the support device according to an embodiment, FIG. 6 is a cross-sectional view taken along VI-VI of FIG. 3, and FIG. 7 is a cross-sectional view taken along VII-VII of FIG. 3.

The support device 100 may support the bottom surface of the housing 41 of the drying device 40, and may support an area corresponding to a position of the compressor 61, that is the lower part of the position at which the compressor 61 is disposed, from among the bottom surface of the housing 41. For example, at least one from among the first support member 110 and the second support member 120 may be disposed to pass the lower part of the compressor 61.

Referring to FIG. 5 and FIG. 6, the second support member 120 may support an area corresponding to the position of the compressor from among the bottom surface of the housing 41.

Referring to FIG. 6, the housing 41 may have a convexly bent area 46 toward the lower direction from a position at which the compressor 61 is disposed, and one area of the second support member 120 which is disposed at the lower part of the compressor 61 may have a concavely bent area 121 to be engaged to the convexly bent area 46 of the housing 41.

In between the concavely bent area 121 of the second support member 120 and the convexly bent area 46 of the housing 41, the cushioning member 132 may be disposed to cushion impact.

Referring to FIG. 7, the first support member 110 may have a convexly bent area 111 toward the upper direction to support a center part of the drying device 40. In addition, in between the convexly bent area 111 toward the upper direction of the first support member 110 and the drying device 40, a cushioning member 131 may be disposed.

Accordingly, the support device 100 may support the lower part of the compressor 61 which is an area at which the load of the drying device 40 is relatively largely carried at the support device 100, and the center part of the drying device 40, and may stably space apart the drying device 40 from the tub 20.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A washing machine, comprising:

a main body;

a tub disposed inside the main body;

a drum rotatably disposed inside the tub;

a drying device including a compressor so that the drying device is configured to remove moisture from air discharged from the tub, heat the air from which the moisture was removed, and supply the heated air to the tub; and a support device disposed between the tub and the drying device and including:

a first support member longitudinally extending along a front and back direction of the main body, and a second support member longitudinally extending along a left and right direction of the main body, wherein at least one of the first support member and the second support member passes below the compressor, so that the first support member and the second support member are thereby configured to support the drying device above the tub.

2. The washing machine of claim 1, wherein, the main body includes a front surface, a back surface, a first side surface, and a second side surface, and the compressor is disposed closer to the back surface of the main body than to the front surface of the main body, and disposed closer to the first side surface than to the second side surface.

3. The washing machine of claim 2, wherein, the second support member is disposed closer to the back surface of the main body than to the front surface of the main body, and an area of the second support member is disposed under the compressor.

4. The washing machine of claim 1, wherein, the drying device further includes a housing which contains the compressor, and the support device is configured to support an area of the housing of the drying device disposed under the compressor.

5. The washing machine of claim 4, wherein, the housing includes a convex area under the compressor, and a portion of the support device which is disposed under the compressor includes a concave area engaged with the convex area of the housing.

6. The washing machine of claim 5, further comprising:

a cushioning member disposed between the concave area of the portion of the support device and the convex area of the housing, and configured to cushion impact between the support device and the housing.

7. The washing machine of claim 6, wherein, the cushioning member is formed of a material including at least one of a sponge and a rubber.

8. The washing machine of claim 1, wherein, the first support member includes a convex area extending in an upward direction and configured to support a center part of the drying device.

9. The washing machine of claim 8, further comprising:

a cushioning member disposed between the convex area of the first support member and the center part of the drying device and configured to cushion impact between the first support member and the drying device.

10. The washing machine of claim 1, wherein, the support device is configured to support the drying device so that the drying device is spaced apart from the tub.

11. The washing machine of claim 1, further comprising:

a cushioning member disposed between the support device and the drying device, and configured to cushion impact between the support device and the drying device.

* * * * *